US010006297B2

(12) United States Patent
Yoshida et al.

(10) Patent No.: US 10,006,297 B2
(45) Date of Patent: Jun. 26, 2018

(54) TURBINE ROTOR BLADE

(71) Applicant: MITSUBISHI HEAVY INDUSTRIES, LTD., Tokyo (JP)

(72) Inventors: Toyotaka Yoshida, Tokyo (JP); Takao Yokoyama, Tokyo (JP); Hirotaka Higashimori, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 275 days.

(21) Appl. No.: 14/761,553

(22) PCT Filed: Feb. 21, 2013

(86) PCT No.: PCT/JP2013/054409
§ 371 (c)(1),
(2) Date: Jul. 16, 2015

(87) PCT Pub. No.: WO2014/128898
PCT Pub. Date: Aug. 28, 2014

(65) Prior Publication Data

US 2015/0361802 A1 Dec. 17, 2015

(51) Int. Cl.
*F01D 5/04* (2006.01)
*F01D 5/14* (2006.01)
(Continued)

(52) U.S. Cl.
CPC ..... *F01D 5/26* (2013.01); *F01D 5/043* (2013.01); *F01D 5/141* (2013.01); *F01D 9/02* (2013.01);
(Continued)

(58) Field of Classification Search
CPC ..... F01D 5/141; F01D 5/143
(Continued)

(56) References Cited

U.S. PATENT DOCUMENTS 5,676,522 A * 10/1997 Pommel ..... F01D 9/041 415/181
6,050,775 A * 4/2000 Erdmann ..... F01D 17/165 384/138
(Continued)

FOREIGN PATENT DOCUMENTS

CN 200955437 Y 10/2007
CN 102378849 A 3/2012
(Continued)

OTHER PUBLICATIONS

International Preliminary Search Report and Written Opinion of the International Searching Authority (Forms PCT/IB/338, PCT/IB/373, PCT/ISA/237 and PCT/IB/326), dated Sep. 3, 2015, for International Application No. PCT/JP2013/054409, together with an English translation thereof.
(Continued)

*Primary Examiner* — Deming Wan
(74) *Attorney, Agent, or Firm* — Birch, Stewart, Kolasch & Birch, LLP

(57) ABSTRACT

In a turbine rotor blade of a radial turbine, especially in a variable-geometry turbine with variable nozzles, an object is to restrict high-order resonance of the turbine rotor blade without increasing the size of a device with a simplified structure. A plurality of turbine rotor blades for a radial turbine is disposed on a hub surface. Each turbine rotor blade includes blade-thickness changing portions, at which at least a blade thickness of a cross-sectional shape at a middle portion of a blade height increases rapidly with respect to a blade thickness of a leading-edge side, at a predetermined position from a leading edge along a blade length which follows a gas flow from the leading edge to a trailing edge. The blade thickness increases to a blade thickness via the blade-thickness changing portions.

6 Claims, 10 Drawing Sheets

(51) Int. Cl.

| | |
|---|---|
| ***F01D 5/26*** | (2006.01) |
| ***F01D 9/02*** | (2006.01) |
| ***F01D 17/16*** | (2006.01) |
| ***F01D 25/24*** | (2006.01) |
| *F02B 37/24* | (2006.01) |

(52) U.S. Cl.
CPC ..... *F01D 17/16* (2013.01); *F01D 25/24* (2013.01); *F01D 17/165* (2013.01); *F02B 37/24* (2013.01); *F05D 2220/30* (2013.01); *F05D 2220/40* (2013.01); *F05D 2260/96* (2013.01)

(58) Field of Classification Search
USPC ..... 415/164, 208.1; 416/223 R
See application file for complete search history.

(56) References Cited

U.S. PATENT DOCUMENTS

| | | | | |
|---|---|---|---|---|
| 2006/0067829 | A1* | 3/2006 | Vrbas | F04D 29/023 416/223 R |
| 2010/0098548 | A1* | 4/2010 | Yokoyama | F01D 1/08 416/223 R |
| 2012/0128480 | A1* | 5/2012 | Gomez | F01D 5/141 415/208.1 |
| 2013/0004321 | A1 | 1/2013 | Yokoyama et al. | |
| 2015/0204195 | A1* | 7/2015 | Klaus | F01D 5/14 416/242 |

FOREIGN PATENT DOCUMENTS

| | | | |
|---|---|---|---|
| GB | 1 053 509 | A | 1/1967 |
| JP | 2006-258108 | A | 9/2006 |
| JP | 2008-151063 | A | 7/2008 |
| JP | 2009-13963 | A | 1/2009 |
| JP | 2009-185686 | A | 8/2009 |
| JP | 2009-243395 | A | 10/2009 |
| JP | 2012-47085 | A | 3/2012 |
| WO | WO 2011/055575 | A1 | 5/2011 |
| WO | WO 2014/016084 | A1 | 1/2014 |

OTHER PUBLICATIONS

International Search Report and Written Opinion of the International Searching Authority (Forms PCT/ISA/210, PCT/ISA/220 and PCT/ISA/237), dated May 14, 2013, for International Application No. PCT/JP2013/054409.

Extended European Search Report effective Mar. 3, 2016 issued in corresponding EP Applcation No. 13875409.8.

Decision to Grant a Patent issued Sep. 16, 2016 in corresponding Japanese Application No. 2015-501169 with an English Translation.

Chinese Office Action effective Dec. 21, 2016 issued in the corresponding CN Application No. 201380070915.3 with an English Translation.

Office Action effective May 11, 2017 issued in the corresponding EP Application No. 13875409.8.

Office Action dated Dec. 19, 2017 issued to the corresponding European Application No. 13875409.8.

* cited by examiner

RELATED ART

RELATED ART

RELATED ART

RELATED ART

RELATED ART

TURBINE ROTOR BLADE

TECHNICAL FIELD

The present invention relates to a turbine rotor blade of a radial turbine used in an exhaust turbocharger or the like, and especially to a technique to avoid resonance of a turbine rotor blade.

BACKGROUND

In an engine used in an automobile or the like, widely known is an exhaust turbocharger in which a turbine is rotated by energy of exhaust gas of the engine, and intake air is compressed by a centrifugal compressor directly coupled to the turbine via a rotation shaft and supplied to the engine, in order to improve the output of the engine.

A turbine rotor blade of a turbine used in the above exhaust turbocharger has a risk that a flow strain occurs in the exhaust gas flow flowing through a turbine housing due to the surrounding structure of the turbine rotor blade, and the flow strain becomes an excitation source which causes resonance in the turbine rotor blade and generates high-cycle fatigue.

For instance, as illustrated in FIG. 8, the flow velocity in the casing for housing a turbine wheel TW becomes lower as the flow approaches the wall surface. In the vicinity of a protruding portion 012 where a terminating end and a starting end of a scroll part of a turbine casing 010 meet, the flow velocity of the exhaust gas decreases, which causes a flow strain E of the exhaust gas flow. The flow strain E is likely to become an excitation source. In view of this, it is necessary to adjust the natural frequency of the turbine rotor blade to be outside the operation range.

Especially in a variable-geometry turbocharger (VG turbocharger), as illustrated in FIG. 9, a nozzle wake (nozzle interaction swirl) F generated at the downstream end of a stator blade nozzle 014 at the upstream side of the turbine wheel TW becomes an excitation source, and thus there is a risk of high-cycle fatigue.

In this case, the excitation frequency is the number of nozzles×the rotation speed, and the resonance is likely to occur in a high-order mode which is a relatively high frequency, or especially in a secondary mode.

As described above, in a variable-geometry turbocharger, resonance is likely to occur in a high-order mode which is a relatively high frequency, or in a secondary mode in particular. Thus, if the resonance of the secondary mode cannot be avoided in an operation range with a high rotation speed, the opening degree of the nozzle of the stator blade is limited to restrict a vibration force applied to the rotor blade, in order to avoid high-cycle fatigue. In this case, there has been a problem of not adequately taking the advantage of the characteristic of the VG turbocharger that the flow rate is freely adjustable within the operation range.

As to the resonance mode of the turbine rotor blade, illustrated in FIG. 10A is an example of the primary mode. A large amplitude part S1 is present at the distal end portion of the trailing edge of the turbine rotor blade 016 in the blade height direction. Further, illustrated in FIG. 10B is an example of the secondary mode. Large amplitude parts S2, S3 are present at respective distal end portions of the leading edge and the trailing edge of the turbine rotor blade 106 in the blade height direction. There is a node S4 between the strong amplitude parts S2, S3.

As to the variable-geometry turbine with variable nozzles, Patent Document 1 (JP2009-185686A) can be mentioned as a conventional technique for reducing a vibration force applied to the turbine rotor blade and restricting resonance of a turbine blade.

Patent Document 1 discloses a variable-geometry turbine including a turbine wheel having turbine blades, and nozzle vanes disposed around the turbine wheel. The nozzle vanes are rotatably supported by vane shafts. The vane angle of the nozzle vanes is adjusted to adjust the opening area of the nozzles. The vanes shafts of the nozzle vanes are arranged at a predetermined pitch along a circle, and the center of the circle is eccentric from the rotational center of the turbine wheel in the radial direction.

CITATION LIST

Patent Literature

Patent Document 1: JP2009-185686A

SUMMARY

Problems to be Solved

In the technique disclosed in Patent Document 1, the vane shafts of the nozzle vanes are arranged at a predetermined pitch in a circle, and the center of the circle is eccentric from the rotational center of the turbine wheel in the radial direction. Thus, the variable-geometry turbine increases in size in accordance with the eccentricity in the radial direction, which may lead to deterioration in the performance of mounting the variable-geometry turbine to a vehicle.

In view of the above problem of the conventional technique, with regard to a turbine rotor blade of a radial turbine, in a variable-geometry turbine including a variable nozzle in particular, an object of the present invention is to restrict high-order resonance of the turbine rotor blade with a simplified structure without increasing the size of an apparatus.

Solution to the Problems

To achieve the above object, a turbine rotor blade for a radial turbine according to the present invention, disposed inside a spirally-shaped scroll formed on a turbine casing into which an operation gas flows and configured to be driven to rotate by the operation gas flowing inwardly in a radial direction through the scroll, includes a blade-thickness changing portion at which at least a blade thickness of a cross-sectional shape at a middle portion of a blade height increases rapidly with respect to a blade thickness of a leading-edge side, at a predetermined position from a leading edge along a blade length which follows a gas flow from the leading edge to a trailing edge. A plurality of the turbine rotor blades is disposed on a hub surface.

According to the present invention, the cross-sectional shape of at least the middle portion of the blade height is thin at the leading-edge side and becomes thick across the blade-thickness changing portion, rapidly changing so that the shape is narrowed at the changing portion.

With the above shape, it is possible to enhance the rigidity of a part of the blade surface (the middle portion in the blade length direction) and to reduce the mass of another part of the blade surface (the leading-edge section in the blade length direction). In this way, it is possible do adjust the natural frequency of the rotor blade, and to make the leading edge side thin to reduce the mass, so as to adjust the secondary natural frequency to become high.

Specifically, the node part of a secondary-mode resonance of the turbine rotor blade is positioned at a position where the blade thickness is increased by the blade-thickness changing portion.

As described above, with the node part of the secondary-mode resonance being disposed at a position where the strength is enhanced by the increase in the blade thickness, the effect to restrict vibration is increased. Further, at the vibration sections at the leading side and trailing side of the rotor blade, the mass is reduced to increase the natural frequency of the rotor blade, which makes it possible to avoid the secondary-mode resonance in the normal operation range.

Further, preferably in the present invention, the radial turbine may be a variable-geometry turbine including a variable nozzle mounted to a nozzle rotation shaft at a gas-inlet flow channel to the turbine rotor blade configured to be driven to rotate, the variable-geometry turbine being configured to vary a turbine capacity by varying a vane angle of the variable nozzle by rotating the variable nozzle about an axial center of the nozzle rotation shaft with a nozzle drive unit.

Specifically, due to the variable nozzles disposed around the turbine rotor blades, high-order resonance which is a relatively high frequency, especially the secondary-mode resonance is likely to occur to the turbine rotor blade due to the excitation source of the number of nozzles×the rotation speed. Thus, the effect to avoid the secondary-mode resonance of the turbine rotor blade in a variable-geometry turbine is high.

Further, preferably in the present invention, the blade-thickness changing portion may be formed in a substantially symmetrical shape with respect to a center line of the cross-sectional shape in the blade height direction on both surfaces at a pressure surface side and a suction surface side of a rotor blade body.

As described above, the blade-thickness changing portion is formed on both surfaces at the pressure surface side and the suction surface side of the rotor blade body, so as to be substantially symmetric with respect to the center line of the cross-sectional shape in the blade-height direction. Thus, the mass is balanced between the pressure surface side and the suction surface side of the turbine rotor blade, so that rotation about the axial center of the nozzle rotation shaft becomes stable.

Further, preferably in the present invention, the blade-thickness changing portion may be formed on any one of the pressure surface side or the suction surface side of the rotor blade body.

As described above, the blade-thickness changing portion is formed only on the pressure surface side or the suction surface side of the rotor blade, so that the other side has a shape that changes gradually. In this way, stagnation of the flow is not generated at the blade-thickness changing portion, which makes it possible to prevent resonance of the rotor blade without affecting the flow loss of the operation gas considerably.

Further, preferably in the present invention, a turbine wheel of the radial turbine may have a scallop shape in which aback board disposed on a back surface of a blade is cut out.

In a turbine wheel of a scallop type with a cut out on the back board on the back surface of the blade, the root part of the blade leading-edge section is not held by a boss part. Thus, when the blade thickness of the leading-edge section is increased, the mass increases and the natural frequency becomes likely to decrease. Thus, with the present invention applied to a turbine wheel of a scallop type, it is possible to reduce the blade thickness at the leading-edge section to increase the natural frequency, which makes it possible to avoid the secondary-mode resonance in the normal rotation range. Further, it is possible to obtain the effect to reduce the mass by the reduction in the blade thickness in the vicinity of the leading edge.

Further, preferably in the present invention, as illustrated in FIG. 5, the blade-thickness changing portion may be disposed within a range of from 0.1 to 0.6 from the leading edge with respect to the entire length of the blade along a flow direction of the operation gas.

As described above, the blade-thickness changing portion is formed within a range of from 0.1 to 0.6 from the leading edge with respect to the entire length of the blade along a flow direction of the operation gas. The lower limit is set to 0.1 in the aim of reducing the mass at the leading-edge section with a synergy effect with the scallop shape by making the blade thickness thin in a range of approximately from 0.1 to 0.2 from the leading edge with respect to the blade entire length, where the back board of the scallop shape does not exist.

Further, the upper limit 0.6 is based on the position of the node of the secondary-mode resonance falling in a range of not less than approximately 0.6, which has been confirmed by a test or calculation.

Accordingly, with the blade-thickness changing portion disposed in a range of from 0.1 to 0.6 from the leading edge, a relationship is satisfied between mass reduction achieved by the lack of the back board and the increase in strength of the node part achieved by positioning the node of the secondary mode at a part with a great blade thickness. As a result, it is possible to avoid the secondary-mode resonance effectively by using a turbine wheel of a scallop shape.

Further, preferably in the present invention, the blade thickness of a part not having the back board may be formed to have the substantially same thickness as the blade thickness of a shroud portion.

As described above, in a turbine wheel of a scallop type, the blade thickness of the rotor blade corresponding to a region without the back board (region D in FIG. 1) being the same as the blade thickness of the shroud portion, the mass in the region of the leading edge is further reduced, which makes it possible to increase the natural frequency securely.

Advantageous Effects

According to the present invention, in the turbine rotor blade for a radial turbine, and especially in the variable-geometry turbine including the variable nozzle, it is possible to restrict high-order resonance of the turbine rotor blade, especially the secondary resonance, with a simplified structure without increasing the size of the device.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

Figure 7:
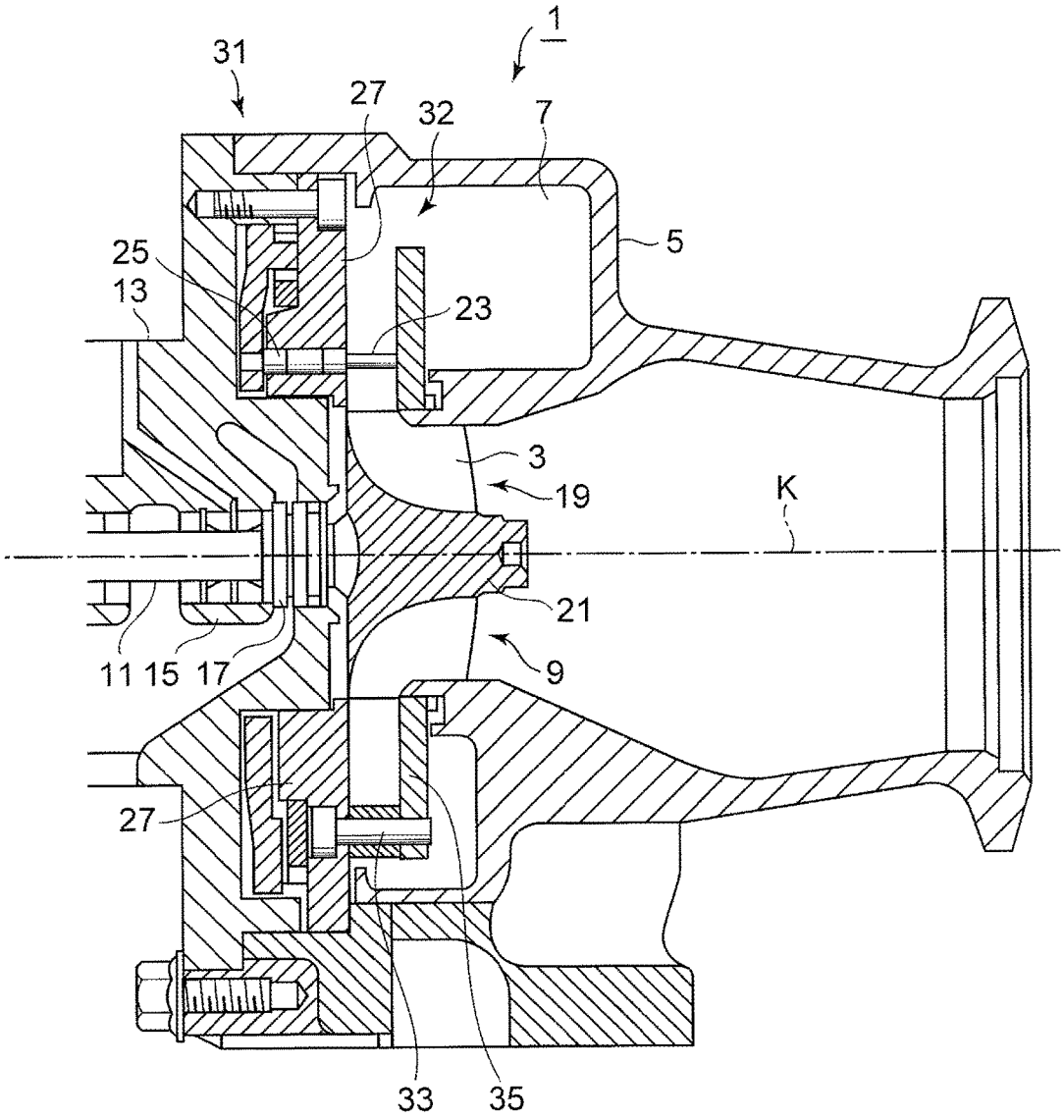
FIG. 7 is an overall configuration diagram of a variable-geometry turbocharger to which the present invention is applied.
Figure 8:
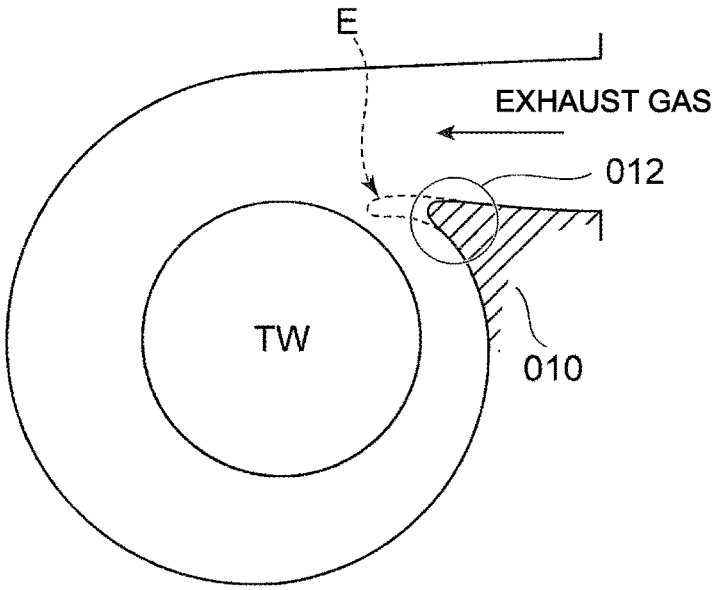
FIG. 8 is an explanatory diagram of an excitation source at a protruding portion of a turbine casing of a turbocharger.
Figure 9:
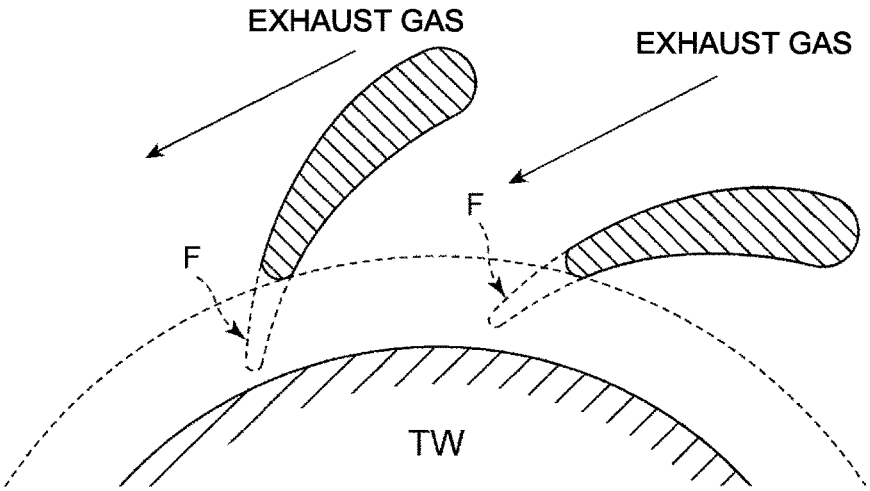
RELATED ART FIG.9
FIG. 9 is an explanatory diagram of an excitation source due to nozzles of a variable-geometry turbocharger.
Figure 10A:
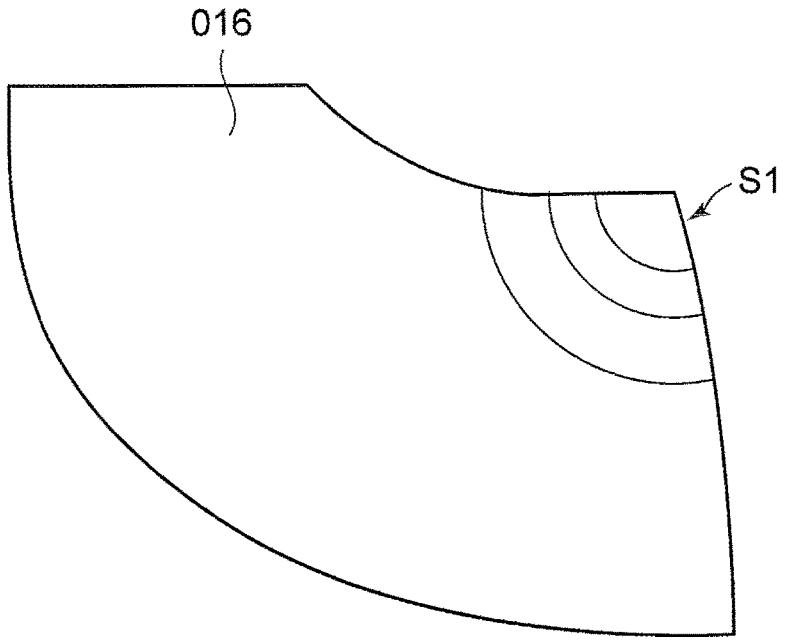
FIG. 10A is a diagram of a resonance mode of a turbine rotor blade, which is the primary mode.
Figure 10B:
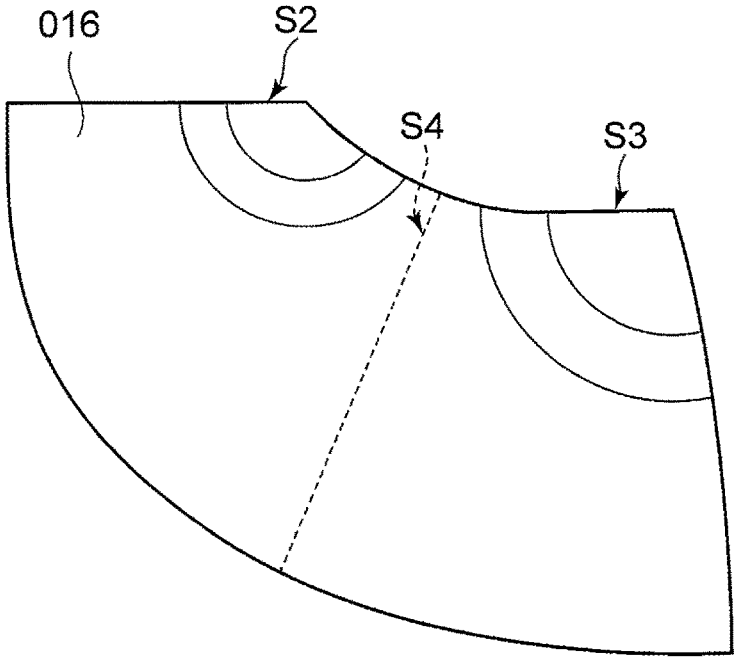
FIG. 10B is a diagram of a resonance mode of a turbine rotor blade, which is the secondary mode.

FIG. 7 is an illustration in which a turbine rotor blade 3 according to the present invention is applied to an exhaust turbocharger with a variable nozzle mechanism.

In FIG. 7, a scroll 7 formed in a swirl shape is formed on the outer circumferential part of a turbine casing 5.

A radial turbine 9 housed in the turbine casing 5 is coupled to a compressor (not illustrated) by a turbine shaft 11 provided coaxially with the compressor. Further, the turbine shaft 11 is supported rotatably to a bearing housing 13 via a bearing 15. The turbine shaft 11 rotates about the rotation axial center K.

The radial turbine 9 includes a turbine shaft 11 and a turbine wheel 19 joined to an end portion of the turbine shaft 11 via a seal part 17. The turbine wheel 19 includes a hub 21 and a plurality of turbine rotor blades 3 disposed on the outer circumferential surface of the hub.

A plurality of nozzle vanes (variable nozzles) 23 is disposed at regular intervals in the circumferential direction around the turbine rotor blades 3 and radially inside the scroll 7. Further, nozzle shafts 25 coupled to the nozzle vanes 23 are rotatably supported to a nozzle mount 27 fixed to the bearing housing 13. The nozzle shafts 25 are rotated by a nozzle drive unit (not illustrated) so as to vary the vane angle of the nozzle vanes and to vary the turbine capacity.

A variable nozzle mechanism 31 which varies the vane angle of the nozzle vanes 23 to vary the turbine capacity is provided. The variable-geometry turbine 32 includes the variable nozzle mechanism 31.

Further, the nozzle vanes 23 are disposed between the nozzle mount 27 and an annular nozzle plate 35 joined to the nozzle mount 27 by joint pins 33 with a gap. The nozzle plate 35 is mounted to an attachment part of the turbine casing 5 by fitting.

Figure 1:
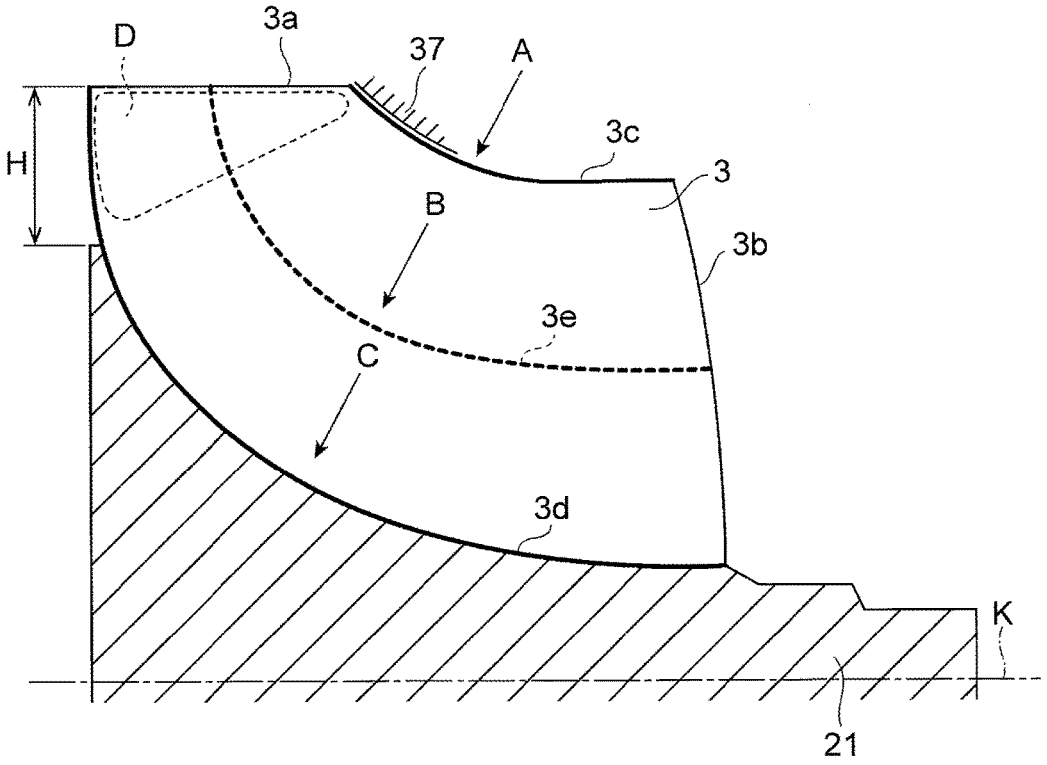
FIG. 1 is an explanatory diagram of a meridional shape of a turbine rotor blade according to the present invention.

The meridional shape of each turbine rotor blade 3 mounted to the outer circumferential surface of the hub 21 is as illustrated in FIG. 1. The turbine rotor blades 3 generate a rotational driving force from energy of exhaust gas that flows in from the scroll 7 inwardly in the radial direction and exits in the axial direction.

Further, each turbine rotor blade 3 includes a leading edge 3*a* which is an edge portion at the upstream side, a trailing edge 3*b* which is an edge portion at the downstream side, and a shroud portion 3*c* which is an outer circumferential edge being an edge portion at the outer side in the radial direction. The shroud portion 3*c* being an outer circumferential edge is covered by a casing shroud part 37 of the turbine casing 5, and is disposed so as to pass through the vicinity of the inner circumferential surface of the casing shroud part 37. A hub portion 3*d* is also formed on the surface of the hub 21.

Further, the hub 21 does not extend to the upper end of the back surface of the turbine rotor blade 3, and thus has a scallop shape. There is no hub or back board at the section H of the back surface of the turbine rotor blade 3, but a rim edge of the turbine rotor blade 3 adjacent to the hub is disposed.

First Embodiment

Next, with reference to FIGS. 2A, 3A, and 4A, the first embodiment of the shape of the turbine rotor blade 3 will be described. In the first embodiment, blade-thickness changing portions 41, 42 are formed on either surface of the turbine rotor blade 3.

Figure 2A:
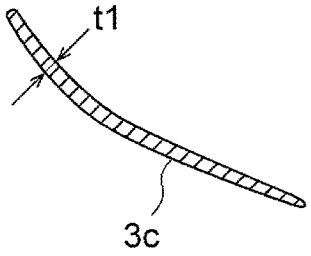
FIG. 2A is a blade cross sectional shape of a shroud portion of the turbine rotor blade as seen from a direction of arrow A, according to the first embodiment.

FIG. 2A is a blade cross sectional shape of a shroud portion 3*c* of the turbine rotor blade 3 as seen from a direction of arrow A in FIG. 1. FIG. 3A is a blade cross sectional shape of a middle portion 3*e* of the turbine rotor blade 3 as seen from a direction of arrow B in FIG. 1. FIG. 4A is a blade cross sectional shape of a hub portion 3*d* of the turbine rotor blade 3 as seen from a direction of arrow C in FIG. 1.

As illustrated in FIG. 2A, the shroud portion 3*c* is formed to have a substantially constant blade thickness "t" across the entire length of the turbine rotor blade 3.

Figure 3A:
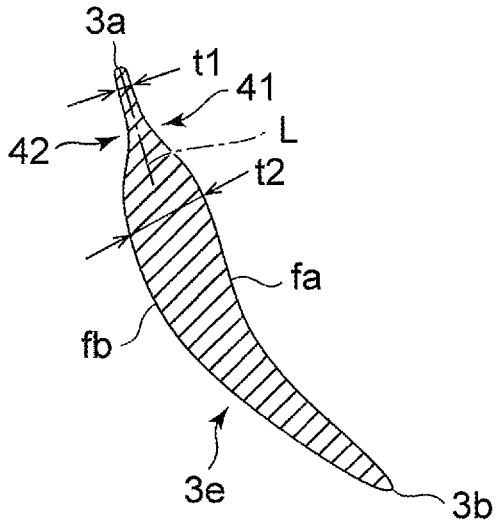
FIG. 3A is a blade cross sectional shape of a middle portion of the turbine rotor blade in the height direction as seen from a direction of arrow B, according to the first embodiment.

As illustrated in FIG. 3A, the middle portion 3*e* represents the blade thickness at the substantially center part in the blade height. The blade-thickness changing portions 41, 42 at which the blade thickness greatly changes are respectively disposed on the pressure surface side fa and the suction surface side fb. The blade thickness is t1 and the same as that of the shroud portion 3*c*, between the blade thick-ness changing portions 41, 42 and the leading edge.

Here, after the blade thickness increases at the blade-thickness changing portions 41, 42, the blade thickness gradually decreases toward the trailing edge, similarly to the conventional configuration.

Figure 4A:
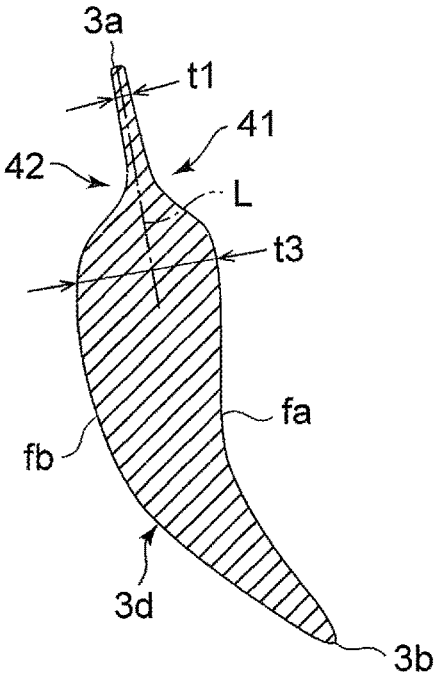
FIG. 4A is a blade cross sectional shape of a hub portion of the turbine rotor blade as seen from a direction of arrow C, according to the first embodiment.

As illustrated in FIG. 4A, the hub portion 3*d* represents a cross-sectional shape of the joint between the turbine rotor blade 3 and the outer circumferential surface of the hub 21, and changes in shape substantially similarly to the middle portion 3*e*.

The blade-thickness changing portions 41, 42 at which the blade thickness greatly changes are respectively disposed on the pressure surface side fa and the suction surface side fb. The blade thickness is t1 and the same as that of the shroud portion 3*c* and the middle portion 3*e*, between the blade thick-ness changing portions 41, 42 and the leading edge.

Further, the blade-thickness changing portions 41, 42 are formed in a substantially symmetrical shape with respect to a center line L of the cross sectional shape of both surfaces of the pressure surface side fa and the suction surface side fb. Thus, it is possible to balance the mass between the pressure surface side fa and the suction surface side fb, which stabilizes installation of the turbine rotor blade 3.

Here, after the blade thickness increases at the blade-thickness changing portions 41, 42, the blade thickness gradually decreases toward the trailing edge, similarly to the conventional configuration.

Figure 2B:
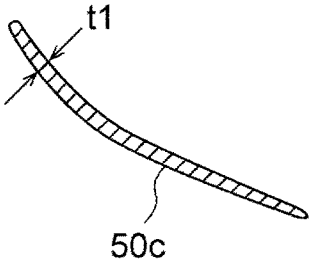
FIG. 2B is a diagram corresponding to FIG. 2A, according to the second embodiment.
Figure 2C:
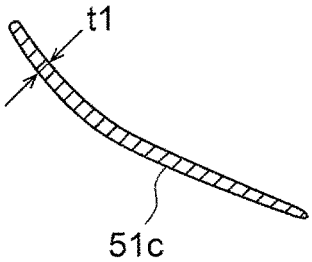
FIG. 2C is a diagram corresponding to FIG. 2A, according to the third embodiment.
Figure 2D:
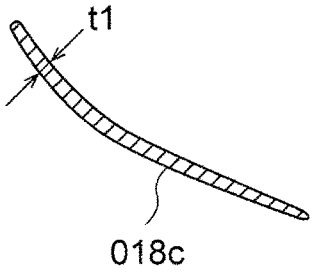
FIG. 2D is a diagram corresponding to FIG. 2A, according to the conventional shape.
Figure 3B:
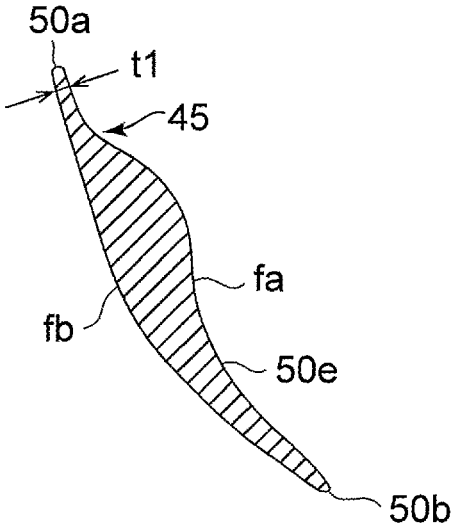
FIG. 3B is a diagram corresponding to FIG. 3A, according to the second embodiment.
Figure 3C:
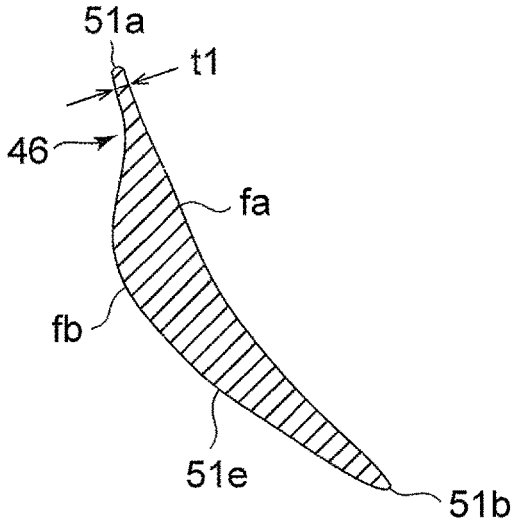
FIG. 3C is a diagram corresponding to FIG. 3A, according to the third embodiment.
Figure 3D:
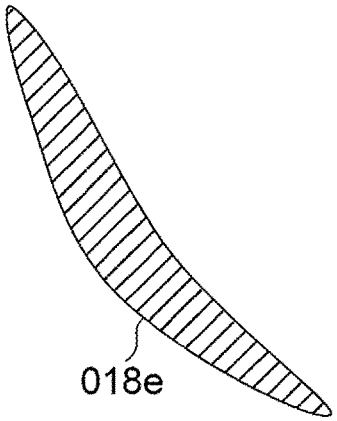
FIG. 3D is a diagram corresponding to FIG. 3A, according to the conventional shape.
Figure 4B:
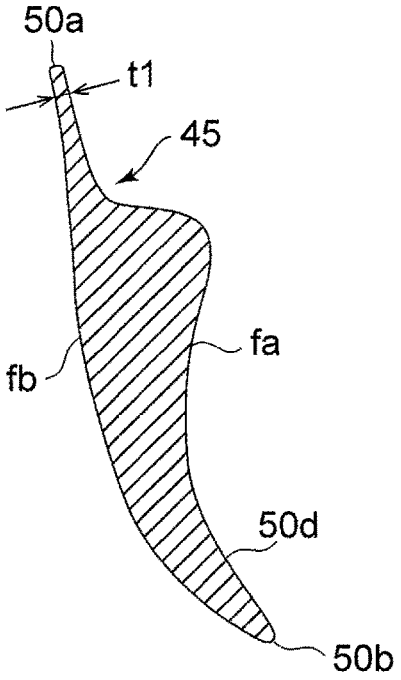
FIG. 4B is a diagram corresponding to FIG. 4A, according to the second embodiment.
Figure 4C:
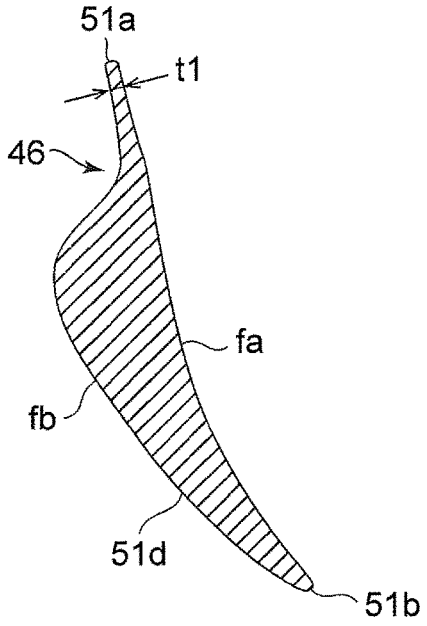
FIG. 4C is a diagram corresponding to FIG. 4A, according to the third embodiment.
Figure 4D:
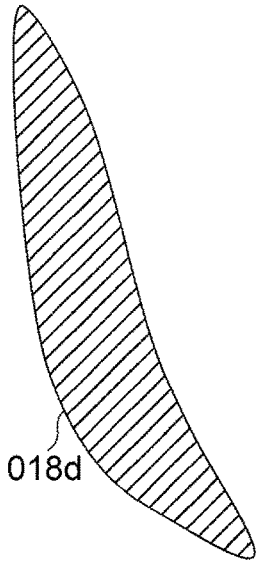
FIG. 4D is a diagram corresponding to FIG. 4A, according to the conventional shape.

Illustrated in FIGS. 2D, 3D, and 4D are cross-sectional shapes of portions corresponding to the shroud portion 018*c*, the middle portion 018*e*, and the hub portion 018*d* of the conventional turbine rotor blade 018. As obviously illustrated in the drawings, there is no radical change in the blade thickness, and the blade thickness changes gradually.

Figure 5:
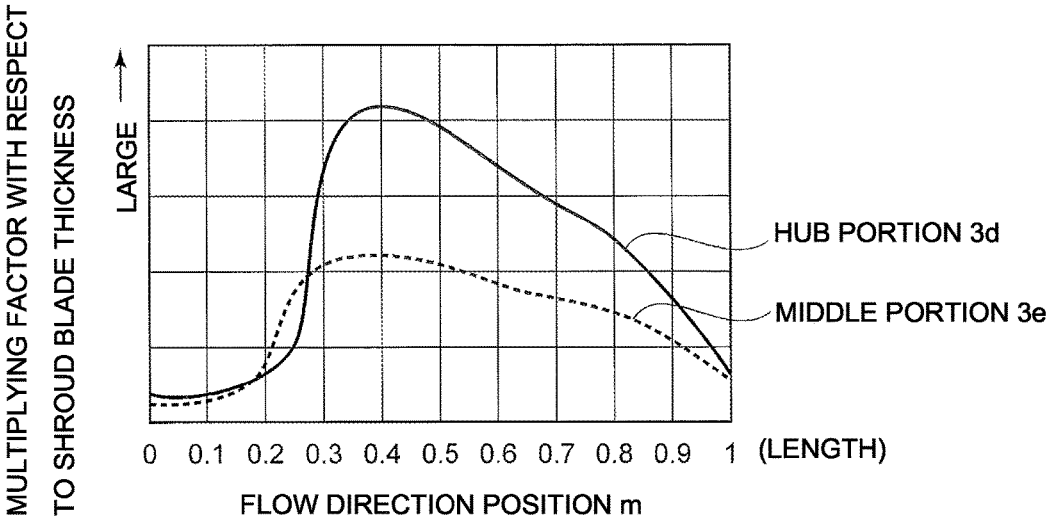
FIG. 5 is a chart of a blade-thickness ratio at a predetermined position in a gas-flow direction of a rotor blade to the blade thickness of the shroud portion.

FIG. 5 illustrates the characteristics of the blade-thickness distribution of the blade thickness t2 of the middle portion 3*e* and the blade thickness t3 of the hub portion 3*d*, with reference to the blade thickness of the shroud portion 3*c* of the present embodiment. The horizontal axis represents the ratio of the directional position m of the flow direction to the entire length of the turbine rotor blade 3 along a gas flow direction, while the vertical axis represents the multiplying factor with respect to the blade thickness t1 of the shroud portion 3*c*.

With reference to FIG. 5, at the flow directional position m=0.1 to 0.2, the multiplying factor of the blade thickness is substantially 1 to 3. Thus, the blade thickness is not quite different from that of the shroud portion 3*c*.

At m=0.2 to 0.4, the blade thickness rapidly increases. After this, the blade thickness gradually decreases.

Accordingly, in a range where m=0.1 to 0.2 before the rapid change, the blade thickness is t1, which is equivalent to the blade thickness of the shroud portion 3*c*, and then rapidly increased. The suitable positions of the blade-thickness changing portions 41, 42 are positions in a range of m=0.1 to 0.2.

According to the present embodiment, the leading edge 3*a* is formed to have the thin blade thickness t1, and the blade thickness increases rapidly across the blade-thickness changing portions 41, 42. The shape is narrowed at the blade-thickness changing portions.

With this shape, it is possible to enhance the rigidity of the blade surface in a range (m=0.3 to 0.7) of the flow direction, and to reduce the mass at the section of the leading edge 3*a*.

Figure 6:
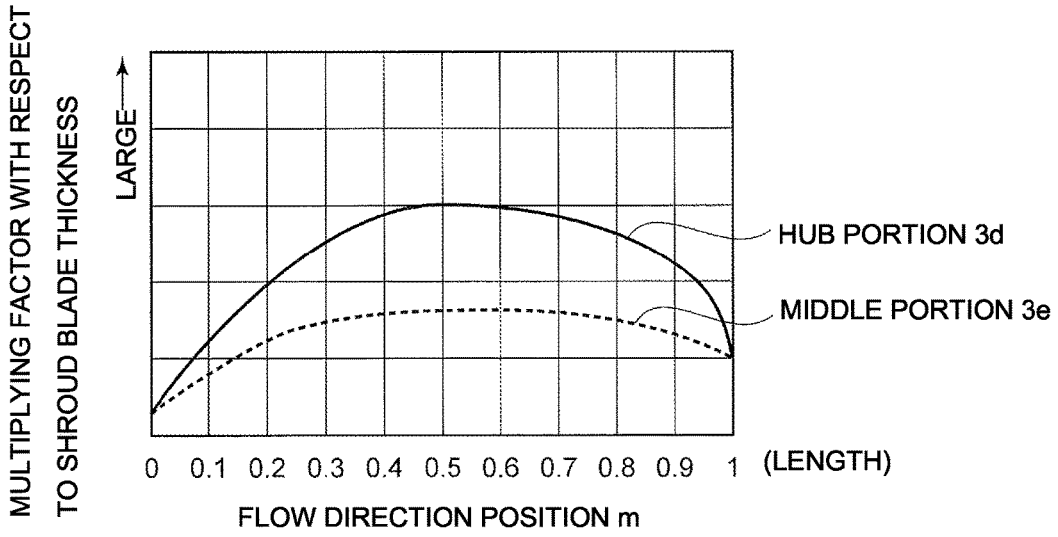
FIG. 6 is a chart corresponding to FIG. 5 for describing the characteristics of the blade thickness of a conventional rotor blade.

In the range of m=0.3 to 0.7 with the enhanced rigidity, the blade thickness is greater than the conventional blade thickness illustrated in FIG. 6.

Here, FIG. 6 is a chart of the characteristics in change of the blade thickness of the conventional turbine rotor blade. The blade thickness is gradually changed, and the change is represented as a positive curve as a whole.

Accordingly, with the node of the secondary-mode resonance being positioned at a section where the strength is enhanced by the increased blade thickness, the effect to restrict vibration is enhanced. Further, the mass is reduced at vibrating sections at the front and rear of the turbine rotor blade 3. In this way, it is possible to increase the natural frequency and to avoid the secondary resonance in the normal operation range.

According to a test or a calculation, the position of the node of the secondary-mode resonance falls within a range where m is approximately not greater than 0.6. Thus, it is possible to obtain the above described regions where the rigidity of the blade surface is increased and where the mass of the leading edge 3*a* is reduced, by setting the positions of the blade-thickness changing portions 41, 42 being the boundary portions between the thin range and the thick range to be m=0.1 to 0.6. Thus, the range m=0.1 to 0.6 is desirable.

Further, according to the present embodiment, due to the nozzle vanes 23 disposed around the turbine rotor blades 3, high-order mode of a relatively high frequency, especially the secondary-mode resonance is likely to occur in the turbine rotor blade 3 from the excitation source of the number of nozzles×the rotation speed. Thus, the present embodiment is effective in avoiding the secondary-mode resonance of the turbine rotor blade 3 in a variable-geometry turbine.

Further, according to the present embodiment, the hub 21 does not extend to the upper end of the back surface of the turbine rotor blades 3, and thus has a scallop shape. At the section H of the back surface of the turbine rotor blades 3, there is no hub or the back board, and there is only the blade-thickness of the turbine rotor blades 3.

Since the back board is cut off, it is possible to achieve a greater effect to reduce the mass of the leading edge 3 portion of the turbine rotor blades 3. Thus, in cooperation with the effect to reduce the mass of the leading edge 3*a* achieved by forming the blade-thickness changing portions 41, 42, it is possible to further increase the natural frequency, which makes it easier to avoid the secondary resonance in the normal operation range.

Further, the thickness of the turbine rotor blade 3 corresponding to the region without the scallop-shaped back board, which is the region D in FIG. 1, is set to be the same as the blade thickness t1 of the shroud portion 3*c*. In this way, the mass at the region of the leading edge 3*a* is further reduced, which makes it possible to increase the secondary natural frequency securely.

Second Embodiment

Next, with reference to FIGS. 2B, 3B, and 4B, the second embodiment of the turbine rotor blade 50 will be described. In the second embodiment, the blade-thickness changing portion 45 is formed only on the pressure surface side fa of the turbine rotor blade 50.

FIG. 2B is a blade cross sectional shape of a shroud portion 50*c* of the turbine rotor blade 50 as seen from a direction of arrow A. FIG. 3B is a blade cross sectional shape of a middle portion 50*e* of the turbine rotor blade 50 as seen from a direction of arrow B. FIG. 4B is a blade cross sectional shape of a hub portion 50*d* of the turbine rotor blade 50 as seen from a direction of arrow C.

As illustrated in FIG. 2B, the shroud portion 50*c* is formed to have a substantially constant blade-thickness t1 across the entire length of the turbine rotor blade 50.

As illustrated in FIG. 3B, the middle portion 50*e* represents the blade thickness at the substantially center part in the blade height. A blade-thickness changing portion 45 at which the blade thickness greatly changes is formed only on the pressure surface side fa.

The blade thickness is t1, which is the same as the blade thickness of the shroud portion 50*c*, between the blade-thickness changing portion 45 and the leading edge.

Further, the blade-thickness changing portion 45 is formed only on the pressure surface side fa, and the other side has a shape that changes gradually.

Here, after increasing at the blade-thickness changing portion 45, the blade thickness gradually decreases toward the trailing edge, similarly to the conventional configuration.

As illustrated in FIG. 4B, the hub portion 50*d* represents the cross-sectional shape of the joint between the turbine rotor blade 3 and the outer circumferential surface of the hub 21, and changes in shape substantially similarly to the middle portion 50*e*.

The blade-thickness changing portion 45 at which the blade thickness greatly changes is formed only on the pressure surface side fa. The blade thickness is t1, which is the same as the blade thickness of the shroud portion 50*c* and the middle portion 50*e*, between the blade-thickness changing portion 45 and the leading edge.

According to the above second embodiment, the blade-thickness changing portion 45 is formed only on the pressure surface side fa, and the surface on the other side has a shape that changes gradually. Thus, stagnation is unlikely occur to a flow as compared to a case where the blade-thickness changing portions are disposed on either surface, which makes it possible to prevent resonance of the rotor blade without affecting the flow loss of the operation gas greatly.

Third Embodiment

Next, with reference to FIGS. 2C, 3C, and 4C, the third embodiment of the turbine rotor blade 51 will be described. In the third embodiment, the blade-thickness changing portion 46 is formed only on the suction surface side fb of the turbine rotor blade 51.

FIG. 2C is a blade cross sectional shape of a shroud portion 51*c* of the turbine rotor blade 51 as seen from a direction of arrow A. FIG. 3C is a blade cross sectional shape of a middle portion 51*e* of the turbine rotor blade 51 as seen from a direction of arrow B. FIG. 4C is a blade cross sectional shape of a hub portion 51*d* of the turbine rotor blade 51 as seen from a direction of arrow C.

As illustrated in FIG. 2C, the shroud portion 51*c* is formed to have the substantially constant blade thickness t1 across the entire length of the turbine rotor blade 51.

As illustrated in FIG. 3C, the middle portion 51*e* represents the blade thickness at the substantially center part in the blade height. A blade-thickness changing portion 46 at which the blade thickness greatly changes is formed only on the suction surface side fb.

The blade thickness is t1, which is the same as the blade thickness of the shroud portion 51*c*, between the blade-thickness changing portion 46 and the leading edge.

Further, the blade-thickness changing portion 46 is formed only on the suction surface side fb, and the surface on the other side has a shape that changes gradually.

Here, after increasing at the blade-thickness changing portion 46, the blade thickness gradually decreases toward the trailing edge, similarly to the conventional configuration.

As illustrated in FIG. 4C, the hub portion 51*d* represents the cross-sectional shape of the joint between the turbine rotor blade 3 and the outer circumferential surface of the hub 21, and changes in shape substantially similarly to the middle portion 51*e*.

The blade-thickness changing portion 46 at which the blade thickness greatly changes is formed only on the suction surface side fb. The blade thickness is t1, which is the same as the blade thickness of the shroud portion 51*c* and the middle portion 51*e*, between the blade-thickness changing portion 46 and the leading edge.

According to the above third embodiment, the blade-thickness changing portion 46 is formed only on the suction surface side fb, and the surface on the other side has a shape that changes gradually. Thus, similarly to the above second embodiment, stagnation is unlikely occur to a flow as compared to a case where the blade-thickness changing portions are disposed on either surface, which makes it possible to prevent resonance of the rotor blades without affecting the flow loss of the operation gas greatly.

INDUSTRIAL APPLICABILITY

According to the present invention, in the turbine rotor blade of a radial turbine, especially in a variable-geometry turbine including variable nozzles, it is possible to restrict high-order resonance of the turbine rotor blade, especially the secondary resonance, with a simplified structure without increasing the size of the device. Thus, the above technique may be advantageously applied to a radial turbine of an exhaust turbocharger for an internal combustion engine.

The invention claimed is:

1. A turbine rotor wheel for driving a radial turbine including a hub and a plurality of turbine rotor blades disposed on an outer circumferential surface of the hub, the turbine rotor wheel being disposed inside a spirally-shaped scroll formed on a turbine casing, said spirally-shaped scroll providing a flow of gas to said turbine rotor wheel to rotate the turbine rotor wheel by the operation gas flowing inwardly in a radial direction through the spirally-shaped scroll, each of the plurality of the turbine rotor blades comprising:

a blade-thickness changing portion at which at least a blade thickness of a cross-sectional shape at a middle portion of a blade height increases rapidly with respect to a blade thickness of a leading-edge side, at a predetermined position from a leading edge along a blade length which follows a gas flow from the leading edge to a trailing edge, wherein the blade thickness on the leading-edge side of the blade-thickness changing portion is the same in the middle portion, a hub portion and a shroud portion, which is an outer circumferential edge portion, of each of the plurality of the turbine rotor blades in the radial direction, wherein the blade-thickness changing portion is disposed within a range of from 0.1 to 0.6 of a length of each of the plurality of the turbine rotor blades from the leading edge with respect to an entire length of each of the plurality of the turbine rotor blades along a flow direction of the operation gas, wherein the blade thickness of the cross-sectional shape at least at the middle portion of the blade height decreases from a downstream side end of the blade-thickness changing portion to the trailing edge, and wherein a node part of a secondary-mode resonance of each of the plurality of the turbine rotor blades is positioned at the predetermined position.

2. The turbine rotor wheel for driving the radial turbine according to claim 1, wherein the radial turbine is a variable-geometry turbine including a variable nozzle mounted to a nozzle rotation shaft at a gas-inlet flow channel to each of the plurality of the turbine rotor blades configured to be driven to rotate, the variable-geometry turbine being configured to vary a turbine capacity by varying a vane angle of the variable nozzle by rotating the variable nozzle about an axial center of the nozzle rotation shaft with a nozzle drive unit.

3. The turbine rotor wheel for driving the radial turbine according to claim 1, wherein the blade-thickness changing portion is formed in a substantially symmetrical shape with respect to a center line of the cross-sectional shape in the blade height direction on both surfaces at a pressure surface side and a suction surface side of a rotor blade body.

4. The turbine rotor wheel for driving the radial turbine according to claim 1, wherein the blade-thickness changing portion is formed on at least one of the pressure surface side and the suction surface side of the rotor blade body.

5. The turbine rotor wheel for driving the radial turbine according to claim 1, wherein a turbine wheel of the radial turbine has a scallop shape in which a back board disposed on a back surface of a blade is cut out.

6. The turbine rotor wheel for driving the a radial turbine according to claim 5, wherein the blade thickness at the region where the back board is cut out is formed to have substantially the same thickness as the blade thickness of a shroud portion, the region being disposed in a range of from 0.1 to 0.2 of the length of the blade from the leading edge with respect to the blade entire length where the blade-thickness changing portion is absent.

* * * * *